US009889332B2

(12) United States Patent
Bowles

(10) Patent No.: US 9,889,332 B2
(45) Date of Patent: Feb. 13, 2018

(54) EXERCISE DEVICE

(71) Applicant: Robert Gary Bowles, Stamford (GB)

(72) Inventor: Robert Gary Bowles, Stamford (GB)

( * ) Notice: Subject to any disclaimer, the term of this patent is extended or adjusted under 35 U.S.C. 154(b) by 0 days.

(21) Appl. No.: 15/124,235

(22) PCT Filed: Mar. 27, 2015

(86) PCT No.: PCT/GB2015/050924

§ 371 (c)(1),
(2) Date: Sep. 7, 2016

(87) PCT Pub. No.: WO2015/150752

PCT Pub. Date: Oct. 8, 2015

(65) Prior Publication Data

US 2017/0014665 A1 Jan. 19, 2017

(30) Foreign Application Priority Data

Apr. 1, 2014 (GB) ..... 1405865.5

(51) Int. Cl.
*A63B 21/06* (2006.01)
*A63B 21/00* (2006.01)
(Continued)

(52) U.S. Cl.
CPC ..... *A63B 21/153* (2013.01); *A63B 21/00069* (2013.01); *A63B 21/018* (2013.01);
(Continued)

(58) Field of Classification Search
CPC ..... A63B 21/00069; A63B 21/018; A63B 21/068; A63B 21/153; A63B 21/1681;
(Continued)

(56) References Cited

U.S. PATENT DOCUMENTS 3,460,392 A 8/1969 Friedrich
3,506,262 A * 4/1970 Wade ..... A63B 21/018 482/120

(Continued)

FOREIGN PATENT DOCUMENTS

WO 2008013750 A1 1/2008
WO 2012156516 A2 11/2012
WO 2013004734 A9 6/2013

*Primary Examiner* — Loan H Thanh
*Assistant Examiner* — Megan Anderson

(57) ABSTRACT

An exercise device (100) is supportable by a swivel mount (116) attached to a karabiner (114) and the swivel mount is arranged to lock under load at 90° increments. The device includes a rotatable reel (103) arranged to have a pair of inelastic straps (113*a*, 113*b*) rotationally wound thereabout from opposite directions. The reel is rotatable in conjunction with a locking mechanism consisting of a toothed sprocket wheel (104) secured to the reel and a manually operable slideable shaft (106) that is located within a barrel (107). Slots (136, 139) in the shaft and barrel, respectively, permit rotational movement of the sprocket wheel and, hence, reel (103) so that the straps (113*a*, 113*b*) may have their length altered against the bias of a coil spring unit (111). Translational movement of the shaft (106) within the barrel (107) causes the full diameter of the shaft (106) to engage between adjacent teeth of the sprocket wheel to lock the reel (103), thereby preventing further adjustment of the straps (113*a*, 113*b*). When the reel is released for rotational movement, so pulling on one or both of the straps against the bias of the spring unit causes the straps to be unwound evenly and reducing the pulling force below that of the spring unit causes the straps to be rotationally wound around the reel from opposite directions.

14 Claims, 8 Drawing Sheets

(51) Int. Cl.
*A63B 21/018* (2006.01)
*A63B 21/068* (2006.01)
*A63B 21/16* (2006.01)

(52) U.S. Cl.
CPC ..... *A63B 21/068* (2013.01); *A63B 21/1663* (2013.01); *A63B 21/1681* (2013.01); *A63B 21/4013* (2015.10); *A63B 21/4015* (2015.10); *A63B 21/4019* (2015.10); *A63B 21/4034* (2015.10); *A63B 21/4035* (2015.10); *A63B 2225/09* (2013.01)

(58) Field of Classification Search
CPC ..... A63B 21/1663; A63B 21/4013; A63B 21/4019; A63B 21/4035; A63B 21/4034; A63B 21/4015; A63B 2225/09; A63B 21/00178
See application file for complete search history.

(56) References Cited

U.S. PATENT DOCUMENTS

| | | | | |
|---|---|---|---|---|
| 3,861,215 | A | 1/1975 | Bradley | |
| 6,315,701 | B1 * | 11/2001 | Shifferaw | A63B 21/012 482/110 |
| 7,044,896 | B2 | 5/2006 | Hetrick | |
| 9,326,908 | B2 * | 5/2016 | Scott | A61H 1/02 |
| 9,427,622 | B2 * | 8/2016 | Thrasher-Rudd | A63B 7/00 |
| 2015/0343253 | A1 * | 12/2015 | Nikkaran | A63B 21/068 482/96 |

* cited by examiner

EXERCISE DEVICE

CROSS REFERENCE TO RELATED APPLICATIONS

This is a National Stage of International Application No. PCT/GB2015/050924, filed Mar. 27, 2015, which claims the priority of British Application No. 1405865.5, filed Apr. 1, 2014, the entire disclosures of which are hereby incorporated by reference in their entirety.

BACKGROUND OF THE INVENTION

1. Field of the Invention

This invention relates to an exercise device known as a body weight exercise device or "suspension trainer".

2. Description of the Prior Art

Such exercise devices have become popular and are generally based on gymnastic rings including an inelastic adjustable strap or rope centrally supported by an anchor that provides distribution between two arms of the strap or rope with a handle at an end of each opposed arms. Such an exercise device is disclosed in U.S. Pat. No. 7,044,896. This device enables a wide variety of exercises to be performed where a user's weight provides resistance that may be varied by the angle of the user's body in relation to the floor and anchor point—the more upright the user stands the less resistance and the more the user leans their body away from the anchor point, the greater the resistance. The aforesaid exercise device disclosed in the U.S. patent is relatively easy to use and can provide a user with a full body workout.

However, the device of the said U.S. Pat. No. 7,044,896 has a number of disadvantages, namely:

1. Adjustment of the length of the strap is achieved by using individual, separate buckles located on each side of the strap between an anchor point and each handle. Thus, each side requires separate adjustment which is both difficult and time consuming to achieve equal strap lengths.

2. The device can be suspended only in line with the anchor point or mounting structure. If an anchor point or mounting structure is at right angles to the area in which a user wishes to workout, the device is twisted by 90° during use.

3. The minimum strap length achievable is limited to approximately half of the maximum strap length. Shorter lengths are not possible which limits the number of configurations and exercises that may be performed.

4. Because the strap is a single length, it can become tangled, especially when the exercise device is being packed for storage.

5. By virtue of using buckles, as disclosed in U.S. Pat. No. 7,044,896, when the separate lengths of the strap are shortened, so the loosened portion may dangle into the exercise zone of a user and become tangled or become an annoyance.

WO2013/004734 overcomes some of these problems and discloses an inelastic strap that is wound around a shaft that is controlled by a ratchet wheel that has the rotation thereof governed by a pawl. Where two straps are utilised, each is wound around a separate, independent rotatable shaft, the shafts being connected together through a transmission.

The present invention seeks to provide a simpler construction which also at least partially mitigates one or more of the fore-noted problems.

SUMMARY OF THE INVENTION

According to this invention there is provided an exercise device including a single rotatable reel arranged to be selectably rotated against the bias of spring means in dependence upon manually operable locking means, said reel having a pair of inelastic straps arranged to be rotationally wound thereabout from opposite directions, whereby when the locking means permits rotation of the reel, pulling on one or both straps against the bias of the spring means causes the straps to be unwound evenly and reducing the pulling force below that of the spring means causes the straps to be contra-rotationally wound around the reel, wherein the reel has a longitudinally extending diametric slot therein and an axle, and the straps are inserted through the slot from differing diametric locations and secured in overlapping manner about the axle.

Advantageously, the locking means comprises a toothed sprocket wheel attached to the reel and a spring biased manually operable shaft slideably mounted in a barrel, said shaft and barrel each having a cut-out therein disposed along a longitudinal axis thereof, said cut-outs having a width greater than a width of the toothed sprocket wheel, whereby the toothed sprocket wheel is arranged to locate through the cut-out in the barrel, and the shaft has at least a portion thereof having a full diameter sufficient to locate between the teeth of the toothed sprocket wheel, and translational motion of the shaft within the barrel permits the toothed sprocket wheel to rotate within the cut-outs of the barrel and shaft, or to have rotation thereof arrested by said full diameter of the shaft engaging between adjacent teeth of the toothed sprocket wheel.

Advantageously, the shaft is prevented from rotation within the barrel by a pin located transverse to the longitudinal axis of the shaft, which said pin engages within a diametric slot in the barrel.

Preferably, the device includes a swivel mount for attaching the device to support means.

Advantageously, the swivel mount includes a mechanism to permit the device to rotate through 360°, locking under load at 90° increments. Conveniently, an end of each strap remote from the reel is terminated with handle means which may include a karabiner.

Advantageously, door mount means is provided comprising a further strap having opposing ends thereof secured to a bar about which is located a pad, whereby the further strap is positional between a door and door frame, the mount means is locatable on one side of the door and the exercise device is attachable to the further strap means on an opposite side of the door.

Advantageously, a lashing strap is provided having a plurality of hoops formed therein, into each of which may be inserted a karabiner.

BRIEF DESCRIPTION OF THE DRAWINGS

The invention will now be described, by way of example, with reference to the accompanying drawings, in which.

In the Figures, like reference numerals denote like parts.

DETAILED DESCRIPTION OF A PREFERRED EMBODIMENT

Figure 1:
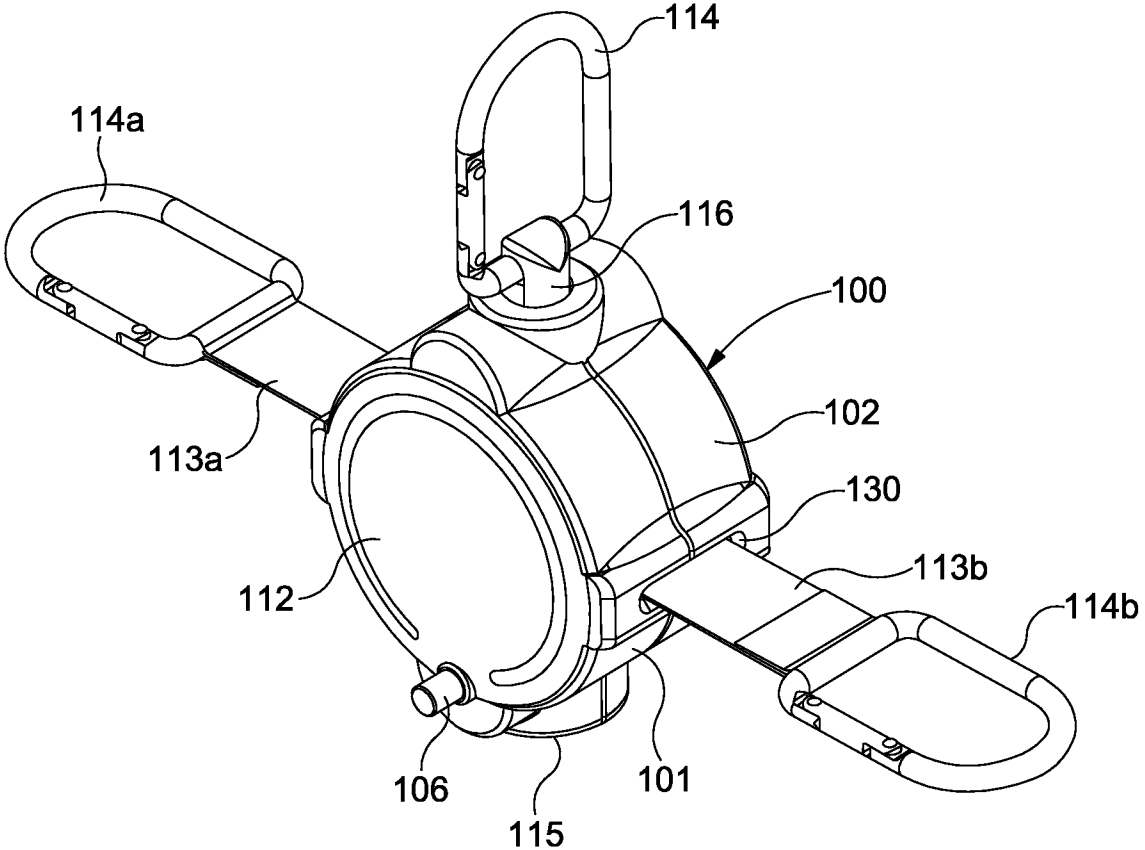
FIG. 1 shows a perspective view of an exercise device in accordance with this invention.
Figure 2:
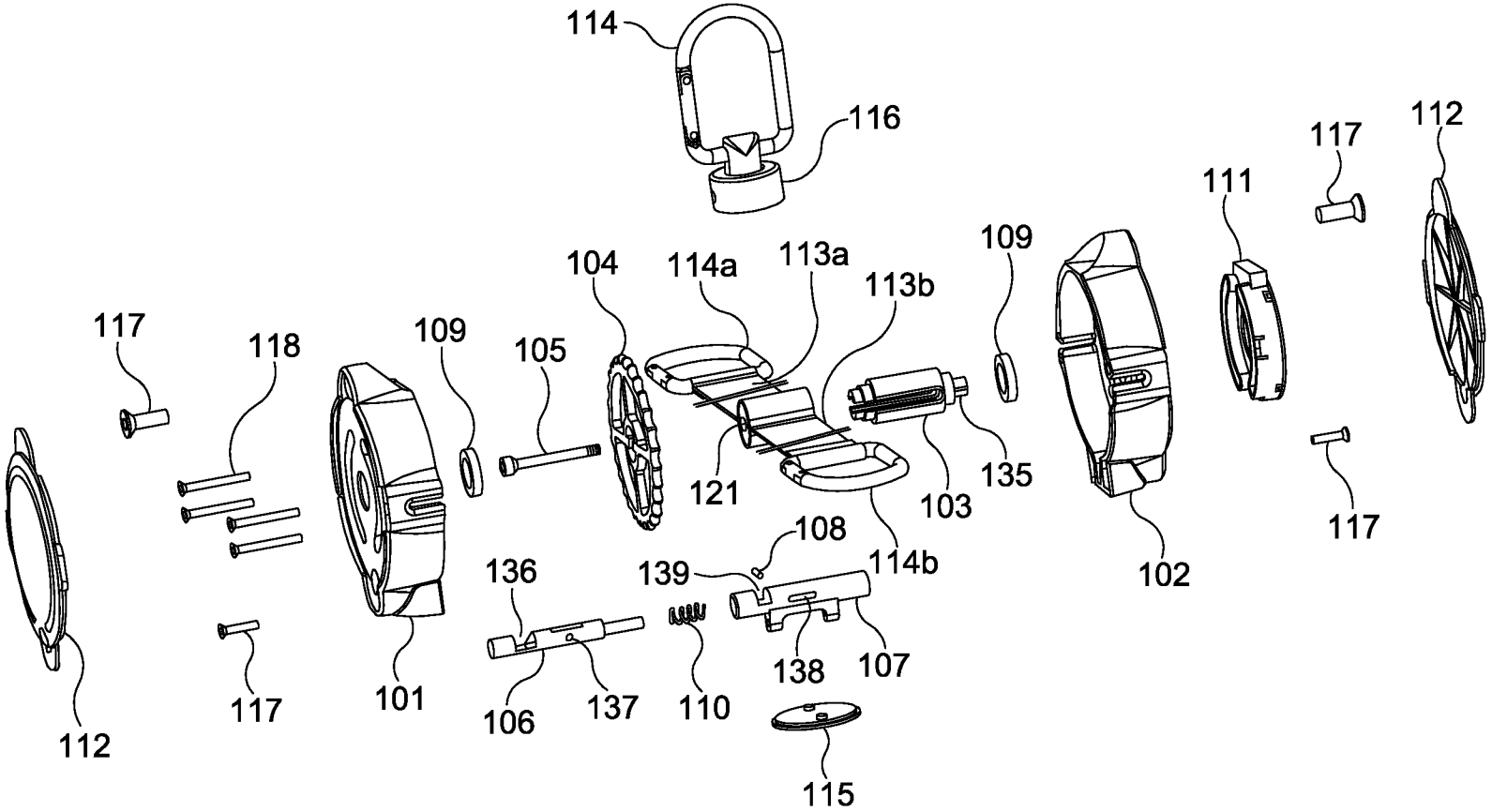
FIG. 2 shows an exploded perspective view of an exercise device in accordance with this invention.
Figure 3:
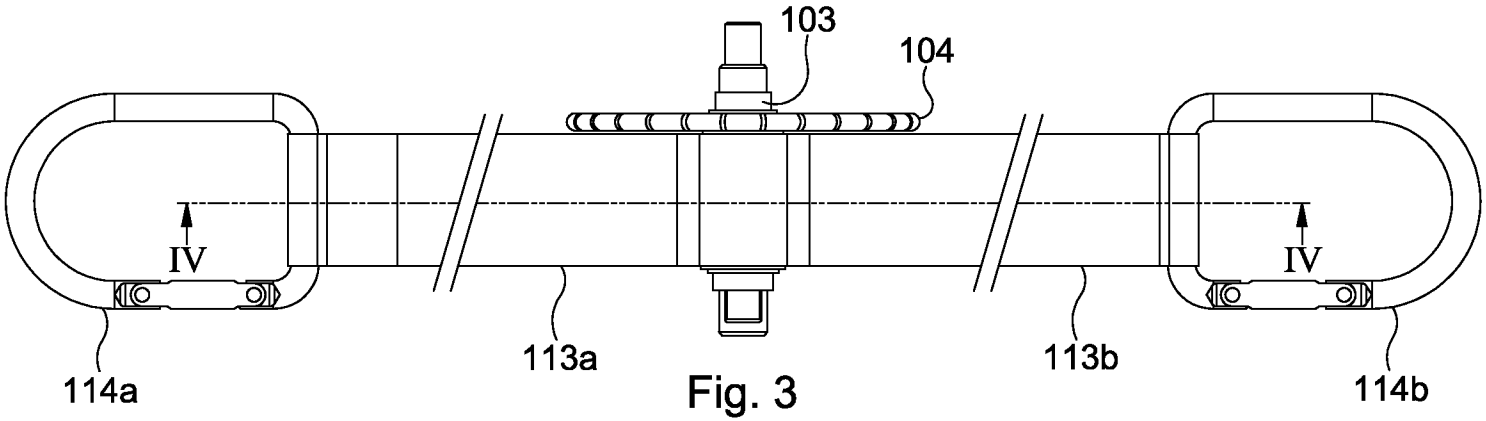
FIG. 3 shows a top elevational view of the exercise device shown in FIGS. 1 and 2 with the casing removed.
Figure 4:
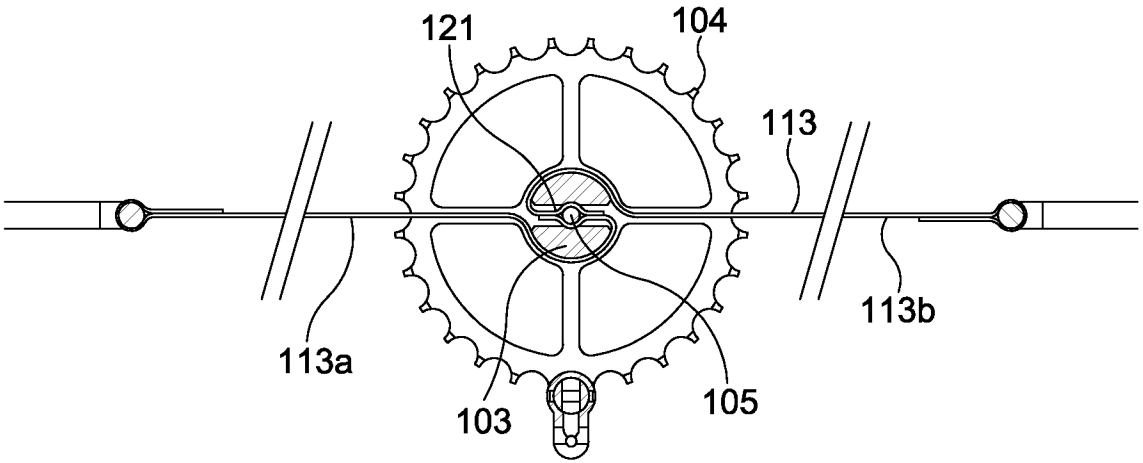
FIG. 4 shows a longitudinal cross-section along double arrow-headed lines IV-IV of FIG. 3.

The exercise device 100 of this invention, shown in FIG. 1, has a longitudinally split housing comprising a front drum-shaped casing 101 and a rear drum-shaped casing 102. Each casing 101, 102 has a respective cover 112. The exercise device 100 is arranged to be supported by a swivel mount 116, preferably arranged to lock under load at 90° increments, that is attached to a karabiner 114. Secured within the front and rear casing by means to be described with reference to FIGS. 2, 3 and 4, are a pair of flat, inelastic straps 113*a* and 113*b*, both of equal length, the straps exiting the casing through a U-shaped elongate aperture 130 in the front and rear casings 101, 102, respectively. It will be realised that a single strap could, alternatively, be used.

Each strap 113*a*, 113*b* has a hoop 121 which is secured at a remote end by, for example, stitching or riveting or gluing, to handle means which may include a karabiner 114*a*, 114*b*. A manually operable push button 106 is provided to lock the extension of the straps 113*a*, 113*b* or to permit adjustment in the length thereof, as will be described later herein.

On an underside of the casings 101, 102 diametrically opposite the swivel mount 116 is a foot 115, preferably made of a rubber material.

Referring to the exploded view of FIG. 2 and FIGS. 3 and 4, the straps 113*a*, 113*b* are wound from opposite directions around the periphery of a reel 103 that has an axial longitudinal slot into which distal ends of each strap 113*a*, 113*b*, remote from karabiners 114*a*, 114*b*, are overlapped around a reel bolt 105 acting as an axle, the overlapping ends of the straps around the reel bolt being secured together by, for example, stitching, gluing or riveting.

The reel bolt 105 also axially secures a toothed sprocket wheel 104 to the reel 103. Opposing ends of the reel 103 are mounted in annular ball race bearings 109, the bearings 109 being fixedly secured in the front casing 101 and the rear casing 102, respectively.

The reel 103 has a spigot 135 that extends through the rear casing 102 into a spiral spring unit 111, whereby the reel 103 is rotatable against the bias of a spiral spring within the spiral spring unit 111.

Figure 7:
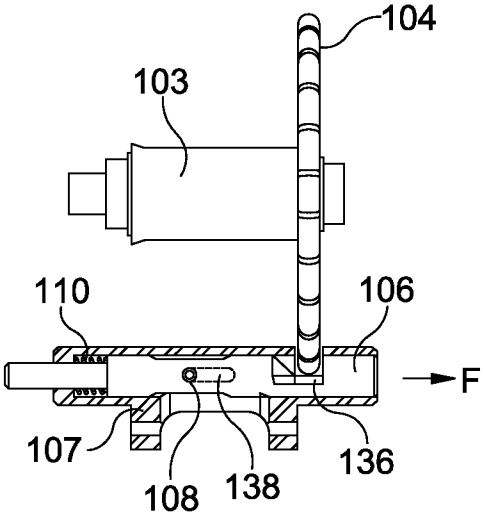
FIG. 7 shows a longitudinal side view along double arrow-headed lines VI-VI of FIG. 5 in another operational position.
Figure 6:
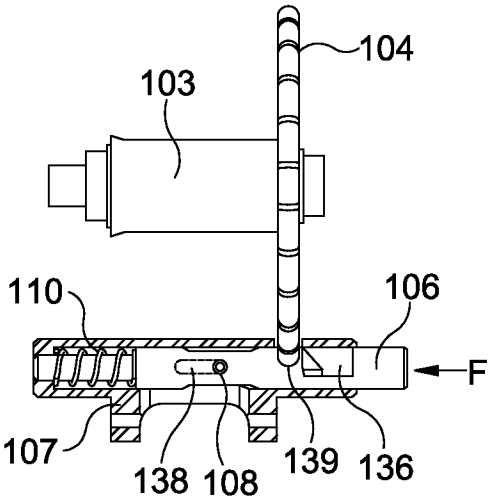
FIG. 6 shows a longitudinal cross-section along double arrow-headed lines VI-VI of FIG. 5 in one operational position.
Figure 5:
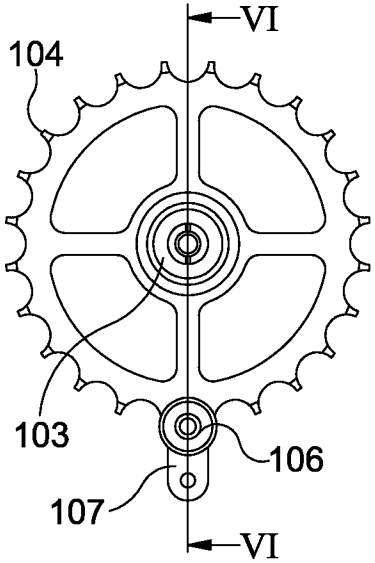
FIG. 5 shows a rear view of a reel and locking mechanism of an exercise device in accordance with the invention.

As shown in FIGS. 5, 6 and 7, the sprocket wheel 104 is rotatable in dependence upon the location of a locking mechanism which comprises the sprocket wheel 104 and a button 106 that is axially slidable within a barrel 107 against the pressure of a compression coil spring 110. The button 106 has a cut away portion 136 wider than the width of the sprocket wheel 104, and a diametric pin hole for locating a pin 108 that extends through a diametric slot 138 in the barrel 107, the pin 108 and slot 138 preventing the button 106 from rotation. A remote end of the button 106 is reduced in diameter to accept thereabout the inside diameter of the coil spring 110 so that the coil spring is restrained between an abutment inside the barrel 107 at one end thereof and a shoulder on the button 106. The barrel 107 has a notch 139 which is slightly wider than the width of the sprocket wheel 104. The front and rear casings 101, 102 and the barrel 107 are secured together by screws 117 and bolts 118.

In the operative position for exercising shown in FIG. 6, the button 106 is moved outwardly from the front casing 101 by the coil spring 110 and the extent of movement is restricted by the pin 108 and slot 138. In this position, the button 106 locates in the root between adjacent teeth of the sprocket wheel so as to lock the sprocket wheel from rotating. Thus, force is exerted by the coil spring 110 in the direction of arrow headed line F shown in FIG. 7. When the button is manually pressed in the direction of arrow headed line F in FIG. 6, so the coil spring 110 is compressed and the button 106 is moved axially longitudinally until it is prevented from further axial translation by the pin 108 abutting an end of the slot 138 and the teeth of the sprocket wheel are free to rotate within the cut-away portion 136 in the button 106.

Thus, the reel 103 is able to rotate against the spring bias provided by the spiral spring unit 111 and, when rotated, the straps 113*a*, 113*b* are wound, or unwound, evenly, i.e. equally, in contra-directions on to or off the reel 103 at the same rate, in dependence upon whether or not the button 106 is pressed or released.

Thus, the desired length of the straps 113*a*, 113*b* is achieved by holding one or both strap ends and pressing and holding the button 106 against the bias of spring 110 to unlock the reel 103 by moving the cut-away portion 136 into registration with the sprocket wheel 104. As long as the button 106 is pushed inwardly of the casing 101, so the straps 113*a*, 113*b* can be adjusted to be longer by pulling them away from the casing 101, 102 and overcoming the spring bias of the spiral spring unit 111. Because the two ends of straps 113*a*, 113*b* are unwound centrally from the same point, so they are always adjusted evenly and at the same rate. When at the desired length, the button 106 is released to lock the reel 103 and the straps 113*a*, 113*b* are thereby locked at the predetermined length. If it is desired to adjust the straps to be shorter, then by holding one or both straps 113*a*, 113*b* and pressing the button 106, the spiral spring unit 111 recoils the straps 113*a*, 113*b* to wind them onto the reel 103 evenly at a rate which is controlled by the user.

Figure 8:
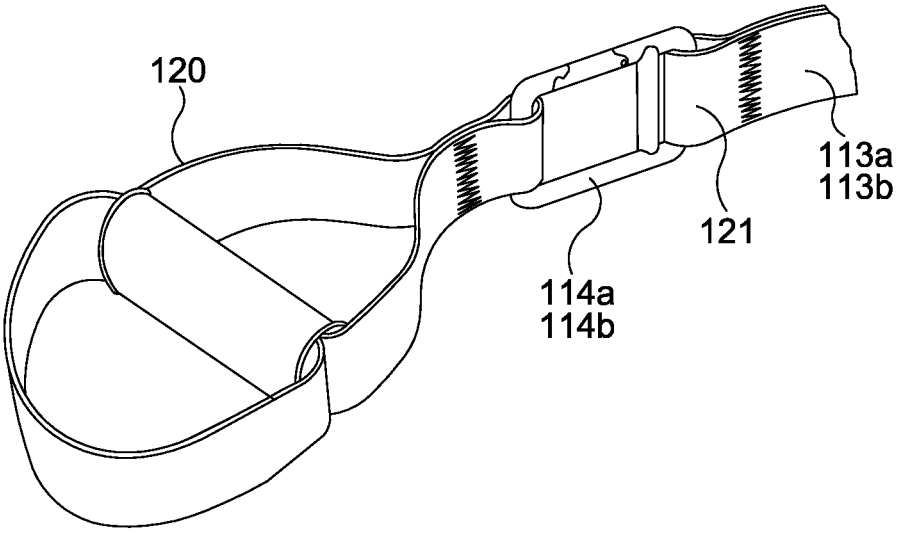
FIG. 8 shows a perspective view of a handle with a foot strap attached to an end of one of the straps.
Figure 11:
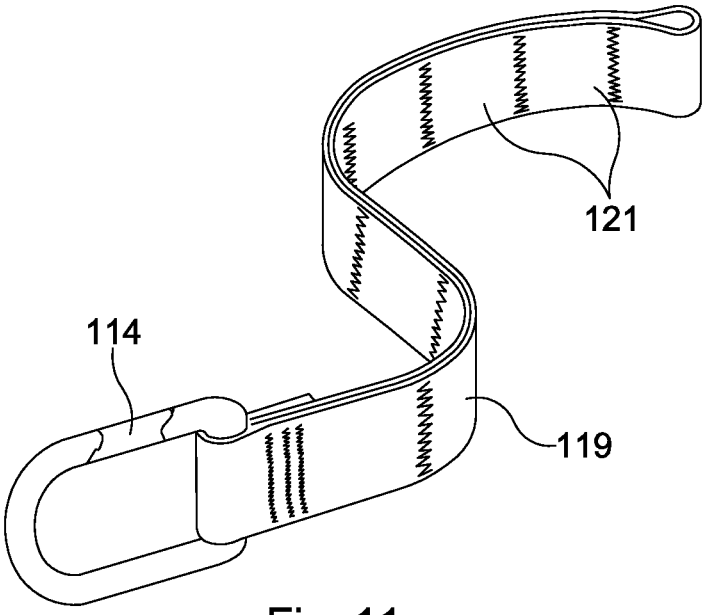
FIG. 11 shows a perspective view of a lashing strap.

Many different strap attachments and handles may be provided which are attached by the karabiners 114*a*, 114*b*. One such attachment is a handle with a foot strap 120, shown in FIG. 8. It is also envisaged that the handle with foot strap 120 may be permanently stitched to the strap ends instead of using a karabiner 114*a*, 114*b*. A lashing strap 119, shown in FIG. 11, consists of a length of double thickness strap with a series of stitched hoops 121 so as to provide a strap of pre-determinedly adjustable length when a karabiner is located through a hoop 121.

Figure 12:
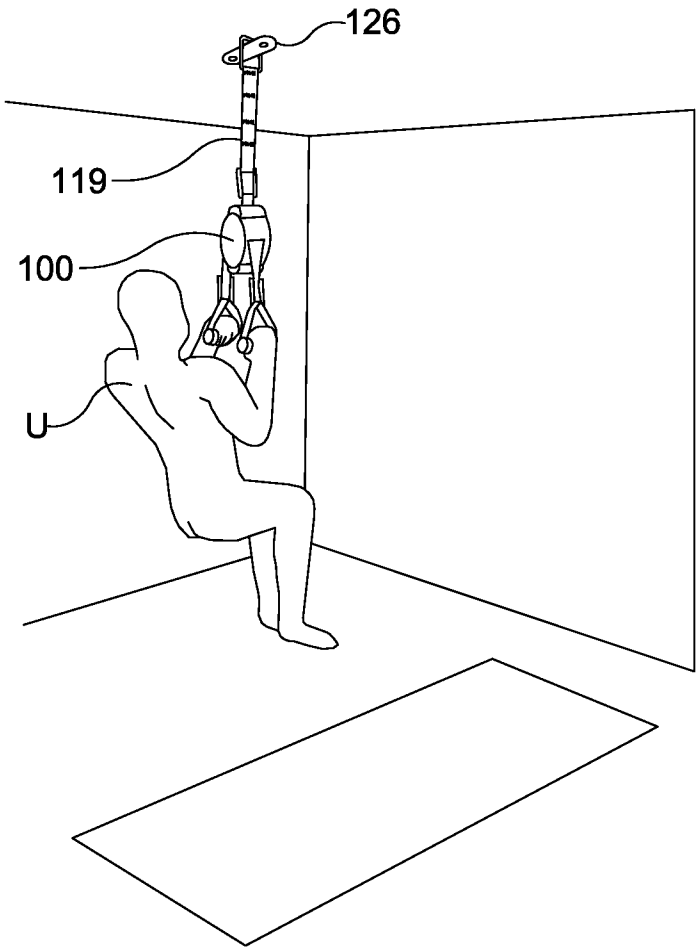

Referring to FIG. 12, a bracket 126 is fixed to a ceiling (although it may, alternatively, be fixed to a wall) and a karabiner is located around the bracket 126 and the device 100 is connected to the bracket 126 by the lashing strap 119. In the FIG. 12, a user U is performing pull-ups.

Figure 13:
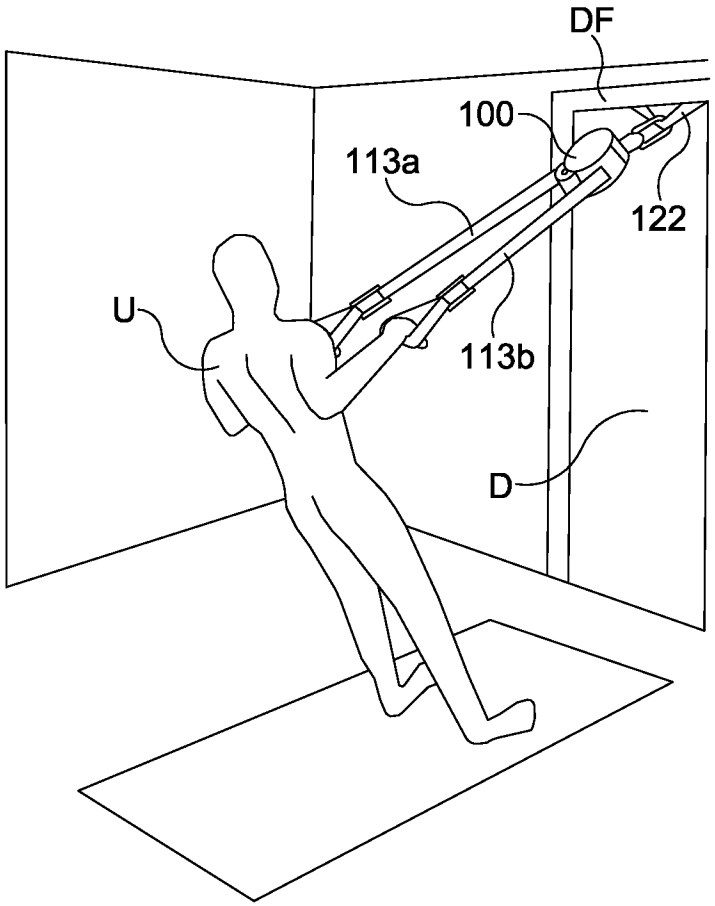
FIGS. 12-15 show the exercise device of the present invention being used in varying exercises.
Figure 15:
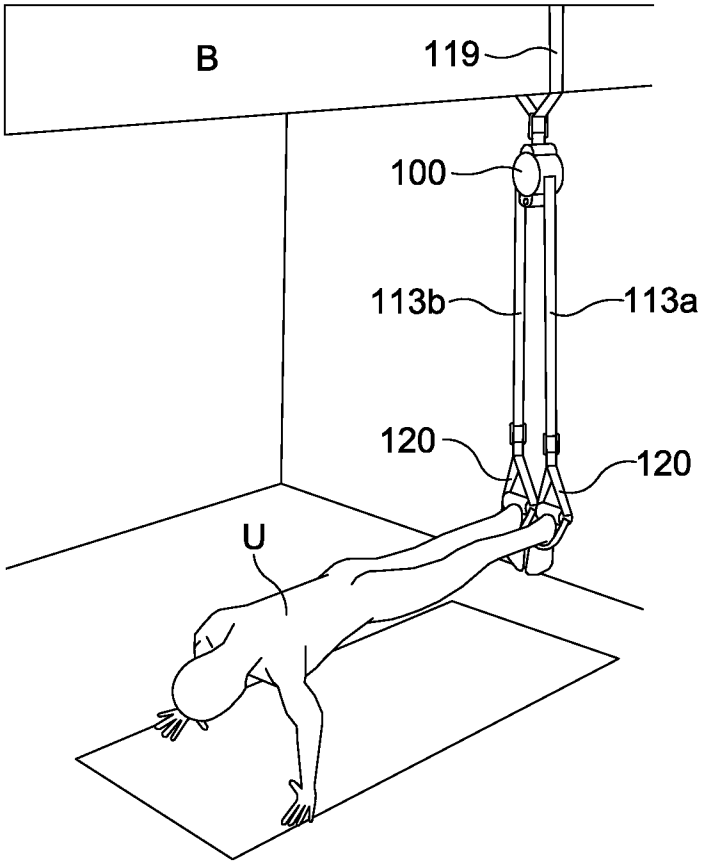
Figure 14:
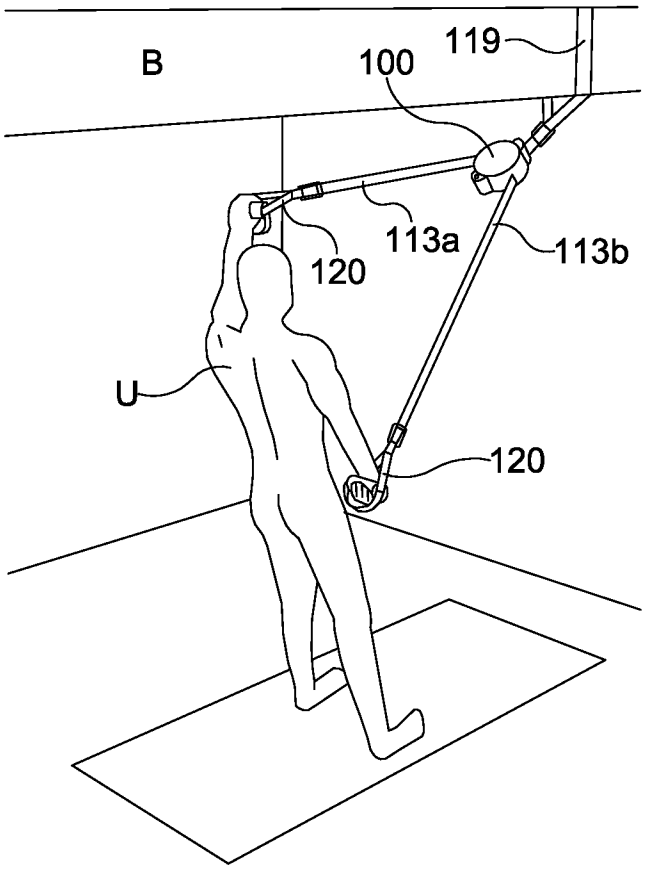

In FIG. 13, the device 100 is connected to a door D and doorframe DF, as will be more fully described with reference to FIGS. 9 and 10 later herein. The user U in FIG. 13 is performing back pulls. In FIGS. 14 and 15, the lashing strap 119 is located about a beam B and, in FIG. 14, the user is performing alternate arm raisers and, in FIG. 15, the user U is performing body exercises using the foot portion of the handle with foot strap 120.

Figure 9:
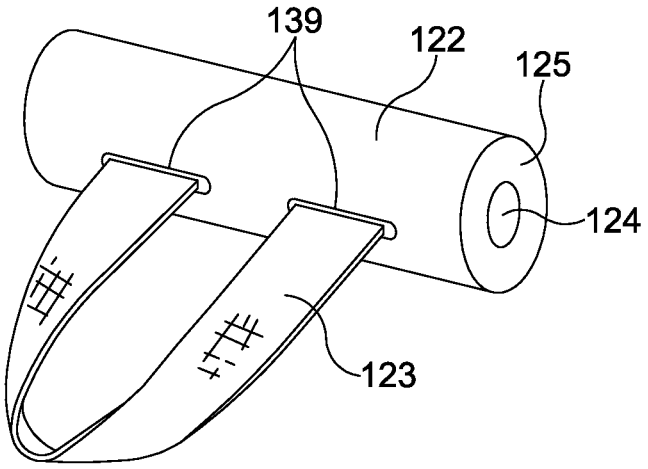
FIG. 9 shows a perspective view of a door mount.
Figure 10:
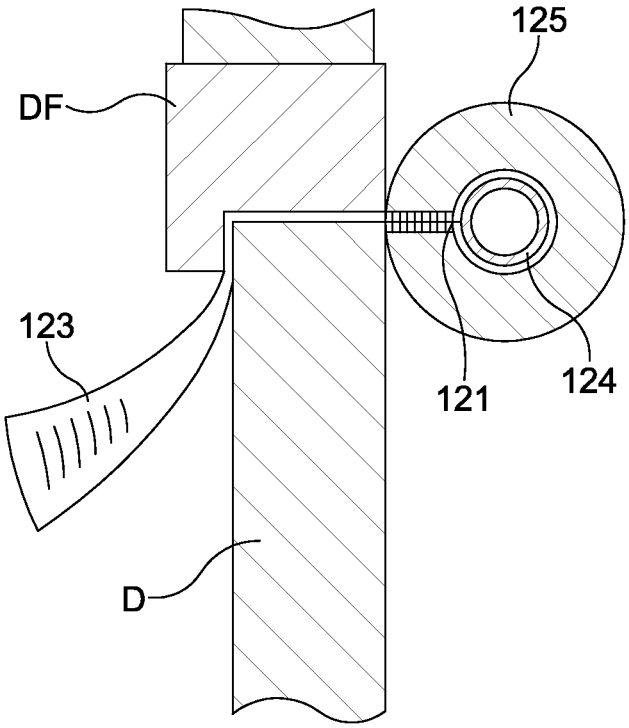
FIG. 10 shows a vertical cross-sectional view of the door mount of FIG. 9 located over a door.

Referring now to FIGS. 9 and 10, the door mount 122 has a bar 124 around which is circumferentially provided a pad 125. A further strap 123 has opposing ends wrapped around the bar 124 to provide a hoop 121 which is stitched to secure the strap to the bar 124. The pad 125 acts as a cushion against a door D and the strap 123 extends through two slots 139 in the pad 125. As shown in FIGS. 10 and 13, the mount 122 is hung over the top of a door D with the padded part on one side and the loop part of the strap 123 on the other side of the door. The device 100 is attached to the strap 123 by karabiner 114, and when the door is closed the padded part pulls against the outside of the door D and the door frame DF to prevent the strap 123 from being pulled through the gap between the door D and door frame DF.

It is to be understood that the lashing strap 119 may be used in conjunction with the door mount 122 and the ceiling/wall bracket 126 if extra length is required. The stitched hoops 121 allow for predetermined length adjustment so that the device 100 can be suspended at a desired height. The lashing strap 119 may also be used over frames or structures such as the beam B or a tree branch to provide an anchor point for the device 100.

The invention claimed is:

1. An exercise device comprising a single rotatable reel arranged to be selectably rotated against a bias of spring means in dependence upon manually operable locking means, said single rotatable reel having a pair of inelastic straps arranged to be rotationally wound thereabout from opposite directions, whereby when the manually operable locking means permits rotation of the single rotatable reel, pulling on one or both of the pair of inelastic straps against the bias of the spring means causes the pair of inelastic straps to be unwound evenly and reducing a pulling force below that of a spring means causes the pair of inelastic straps to be contra-rotationally wound around the single rotatable reel wherein the single rotatable reel has a longitudinally extending diametric slot therein and an axle, and the pair of inelastic straps are inserted through the longitudinally extending diametric slot from differing diametric locations and secured in overlapping manner about the axle.

2. An exercise device as claimed in claim 1, wherein the exercise device includes a swivel mount for attaching the exercise device to support means.

3. An exercise device as claimed in claim 2, wherein the swivel mount includes a mechanism to permit the exercise device to rotate through 360°, locking under load at 90° increments.

4. An exercise device as claimed in claim 3, wherein a lashing strap is provided having a plurality of hoops formed therein, into each of the plurality of hoops which a karabiner is configured to be inserted.

5. An exercise device as claimed in claim 2, wherein a lashing strap is provided having a plurality of hoops formed therein, into each of the plurality of hoops which a karabiner is configured to be inserted.

6. An exercise device as claimed in claim 1, wherein the manually operable locking means comprises a toothed sprocket wheel having teeth attached to the single rotatable reel and a spring biased manually operable shaft slideably mounted in a barrel, said spring biased manually operable shaft and barrel each having a cut-out therein disposed along a longitudinal axis thereof, said cut-outs having a width greater than a width of the toothed sprocket wheel, whereby the toothed sprocket wheel is arranged to locate through the cut-out in the barrel, and the spring biased manually operable shaft has at least a portion thereof having a full diameter sufficient to locate between the teeth of the toothed sprocket wheel, and translational motion of the spring biased manually operable shaft within the barrel permits the toothed sprocket wheel to rotate within the cut-outs of the barrel and the spring biased manually operable shaft, or to have rotation thereof arrested by said full diameter of the spring biased manually operable shaft engaging between adjacent teeth of the toothed sprocket wheel.

7. An exercise device as claimed in claim 6, wherein the spring biased manually operable shaft is prevented from rotation within the barrel by a pin located transverse to the longitudinal axis of the shaft, which said pin engages within a diametric slot in the barrel.

8. An exercise device as claimed in claim 7, wherein a lashing strap is provided having a plurality of hoops formed therein, into each of the plurality of hoops which a karabiner is configured to be inserted.

9. An exercise device as claimed in claim 1, wherein an end of each of the pair of inelastic straps remote from the single rotatable reel is terminated with handle means including a karabiner.

10. An exercise device as claimed in claim 9, wherein a lashing strap is provided having a plurality of hoops formed therein, into each of the plurality of hoops which a karabiner is configured to be inserted.

11. An exercise device as claimed in claim 1, wherein door mount means is provided comprising a further strap having opposing ends thereof secured to a bar about which is located a pad, whereby the further strap is positional between a door and door frame, the door mount means is locatable on one side of the door and the exercise device is attachable to the further strap on an opposite side of the door.

12. An exercise device as claimed in claim 11, wherein a lashing strap is provided having a plurality of hoops formed therein, into each of the plurality of hoops which a karabiner is configured to be inserted.

13. An exercise device as claimed in claim 6, wherein a lashing strap is provided having a plurality of hoops formed therein, into each of the plurality of hoops which a karabiner is configured to be inserted.

14. An exercise device as claimed in claim 1, wherein a lashing strap is provided having a plurality of hoops formed therein, into each of the plurality of hoops which a karabiner is configured to be inserted.

* * * * *